US005199127A

United States Patent [19]

Van Newenhizen et al.

[11] Patent Number: 5,199,127

[45] Date of Patent: Apr. 6, 1993

[54] METHOD FOR RINSING FABRIC ARTICLES IN A VERTICAL AXIS WASHER

[75] Inventors: Jeanne C. Van Newenhizen, Benton Township, Berrien County; Mark B. Kovich, St. Joseph Township, Berrien County; Jim J. Pastryk, Weesaw Township, Berrien County; Anthony H. Hardaway, Lincoln Township, Berrien County, all of Mich.

[73] Assignee: Whirlpool Corporation, Benton Harbor, Mich.

[21] Appl. No.: 816,168

[22] Filed: Jan. 2, 1992

[51] Int. Cl.[5] ..... D06F 21/08

[52] U.S. Cl. ..... 8/158; 8/159

[58] Field of Search ..... 8/158, 159; 68/148, 68/174

[56] References Cited

U.S. PATENT DOCUMENTS

| | | | |
|---|---|---|---|
| 2,302,012 | 11/1942 | Dyer | 68/23 |
| 2,742,772 | 4/1956 | Romine | 68/23 |
| 3,066,521 | 12/1962 | Gillessen | 68/148 X |
| 3,184,933 | 5/1965 | Gaugler | 68/23 |
| 3,216,226 | 11/1965 | Alger et al. | 68/23 |
| 3,387,310 | 6/1968 | Marshall | 8/158 |
| 3,557,579 | 1/1971 | Marshall | 68/23.5 |
| 3,740,975 | 6/1973 | Cornelius | 68/18 F |
| 4,024,735 | 5/1977 | Marchiselli | 68/16 |

*Primary Examiner*—Philip R. Coe

*Attorney, Agent, or Firm*—Stephen D. Krefman; Thomas J. Roth; Thomas E. Turcotte

[57] ABSTRACT

The present invention provides a method of rinsing fabric in a washer having a wash chamber rotatable about a vertical axis. Water is added to the wash chamber while rotating the wash chamber about its vertical axis a number of revolutions sufficient to cause the fabric, rinse water and wash chamber to rotate at approximately the same speed. The wash chamber is periodically decelerated to cause the fabric and rinse water to move relative to the wash chamber due to rotational inertia of the fabric and rinse water. The fabric is caused to tumble within the wash chamber as the wash chamber decelerates by impinging the fabric on structures in the wash chamber as the fabric is moving relative to the wash chamber. A spray of rinse water is directed onto the fabric during a first period of time as the fabric is rotating with and tumbling in the wash chamber. The rinse water is then drained from the wash chamber. Finally, the rinse water is removed from the fabric by spinning and draining the wash chamber.

18 Claims, 10 Drawing Sheets

METHOD FOR RINSING FABRIC ARTICLES IN A VERTICAL AXIS WASHER

BACKGROUND OF THE INVENTION

The present invention relates to automatic clothes washers and more particularly to a method of rinsing fabric in a vertical axis clothes washer.

Attempts have been made to provide an automatic clothes washer which provides comparable or superior wash results to present commercially available automatic washers, yet which uses less energy and water. For example, such devices and wash processes are shown and described in U.S. Pat. Nos. 4,784,666 and 4,987,627, both assigned to the assignee of the present application, and incorporated herein by reference.

The basis of these systems stems from the optimization of the equation where wash performance is defined by a balance between the chemical (the detergent efficiency and water quality), thermal (energy to heat water), and mechanical (application of fluid flow through—fluid flow over—fluid impact—fabric flexing) energy inputs to the system. Any reduction in one or more energy forms requires an increase in one or more of the other energy inputs to produce comparable levels of wash performance.

Significantly greater savings in water usage and energy usage than is achieved by heretofore disclosed wash systems and methods would be highly desirable.

SUMMARY OF THE INVENTION

The swirl rinse cycle of the present invention utilizes a basket structure and fluid conduits and valves which permit the reduction of mechanical, fluid and thermal inputs to the rinse cycle. Two swirl rinses using four to eight gallons of water are used to equate to the performance of one conventional deep rinse utilizing twenty-two gallons of water. The swirl rinse offers opportunities for a more uniform application of fabric softener products than spray rinse in the second rinse.

In the swirl rinse cycle, the basket continues to spin after the final extract of the wash liquor with a fifteen second time delay to assure that all of the wash liquor has been pumped down the drain. The cold water valve is opened until the water level sensor is satisfied, and is then closed. This is approximately four to eight gallons of water. The fresh water is sprayed directly onto the clothes load while the basket accelerates and decelerates.

For example, once the basket has filled the desired amount of water, the basket accelerates slowly to a predetermined speed dependent on the size and number of basket holes and the leakage rate of the valves. The acceleration may take numerous basket revolutions to achieve the preferred speed where the clothes travel up the side wall of the basket with the assistance of the floor ramp, the shape of the basket side wall and the effects of centrifugal forces. The basket is then rapidly decelerated.

The fresh water sprayed directly onto the clothes load dilutes the detergent in the clothes as it passes through the load and basket. The swirl rinse cycle may include two rinses of approximately four minutes to approximate a deep rinse.

DESCRIPTION OF THE PREFERRED EMBODIMENTS WASHER AND FLUID FLOW PATH CONSTRUCTION

Figure 1:
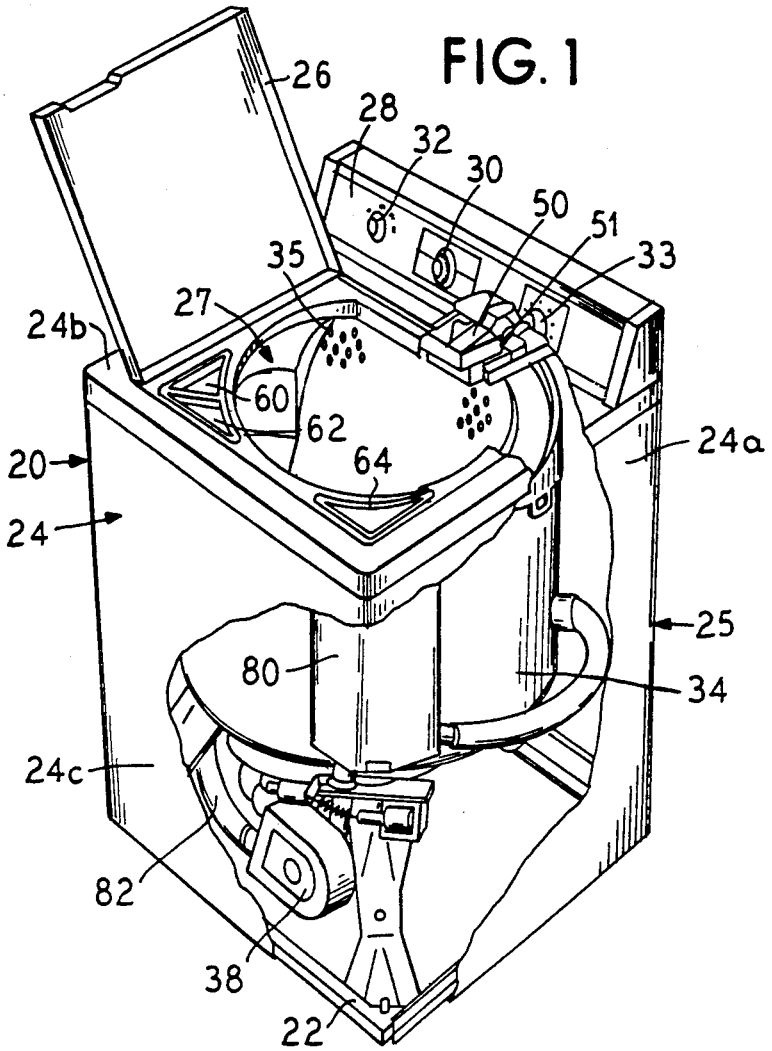
FIG. 1 is a perspective view of an automatic washer, partially cut away to illustrate various interior components.
Figure 5:
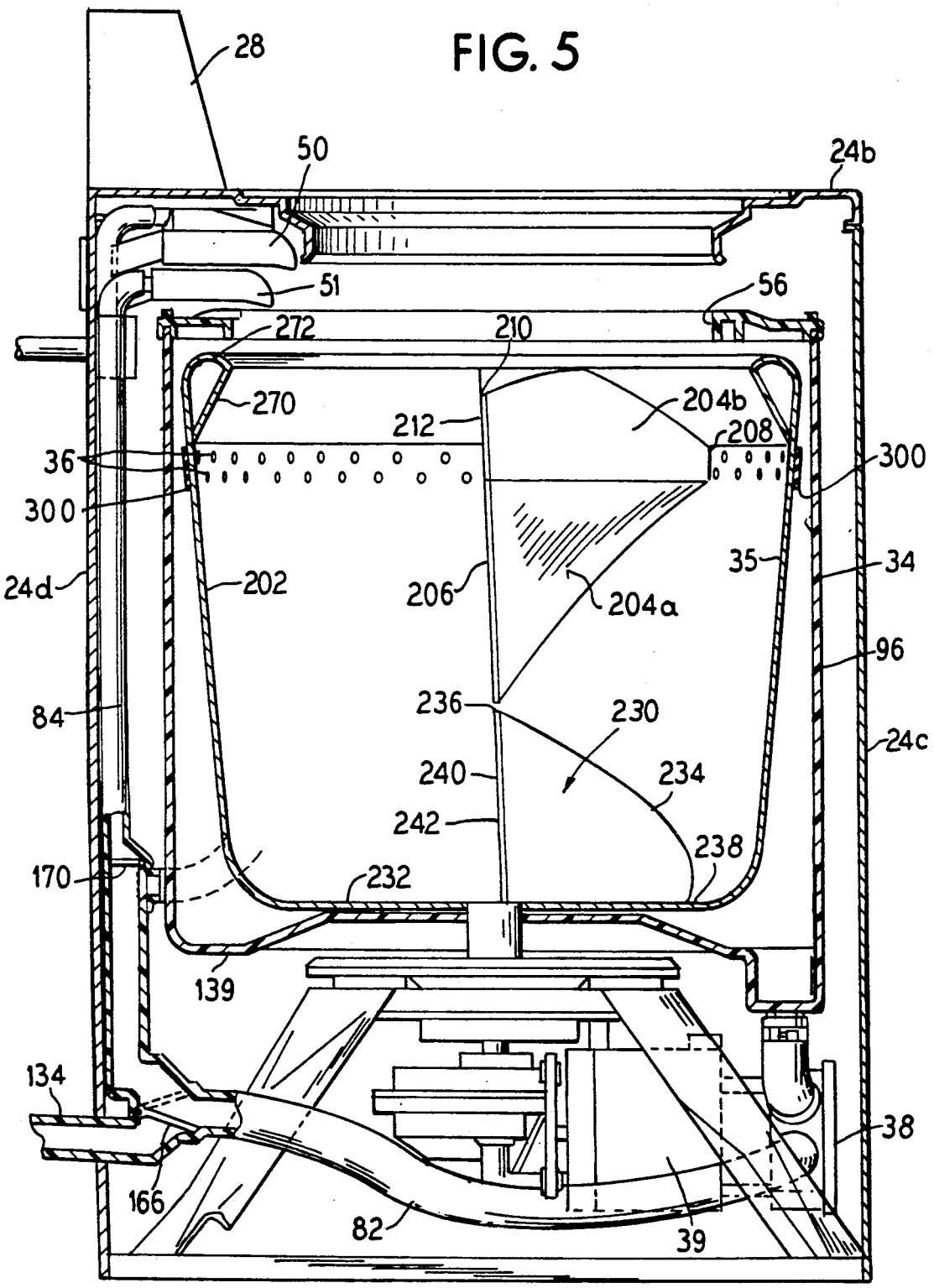
FIG. 5 is a side sectional view of the washer.

In FIG. 1, reference numeral 20 indicates generally a washing machine of the automatic type, i.e., a machine having a pre-settable sequential control means for operating a washer through a preselected program of automatic washing, rinsing and drying operations in which the present invention may be embodied. The machine 20 includes a frame 22 carrying vertical panels 24 forming the sides **24*a*, top 24*b*, front 24*c* and back 24*d* (FIG. 5) of the cabinet 25 for the washing machine 20. A hinged lid 26 is provided in the usual manner to provide access to the interior or treatment zone 27 of the washing machine 20. The washing machine 20 has a console 28 including a timer dial 30 or other timing mechanism and a temperature selector 32 as well as a cycle selector 33** and other selectors as desired.

Internally of the machine 20 described herein by way of exemplifications, there is disposed an imperforate fluid containing tub 34 within which is a spin basket 35 with perforations or holes 36 therein, while a pump 38 is provided below the tub 34. The spin basket 35 defines a wash chamber. A motor 39 (FIG. 5) is operatively connected to the basket 35 to rotate the basket relative to the stationary tub 34.

Figure 6:
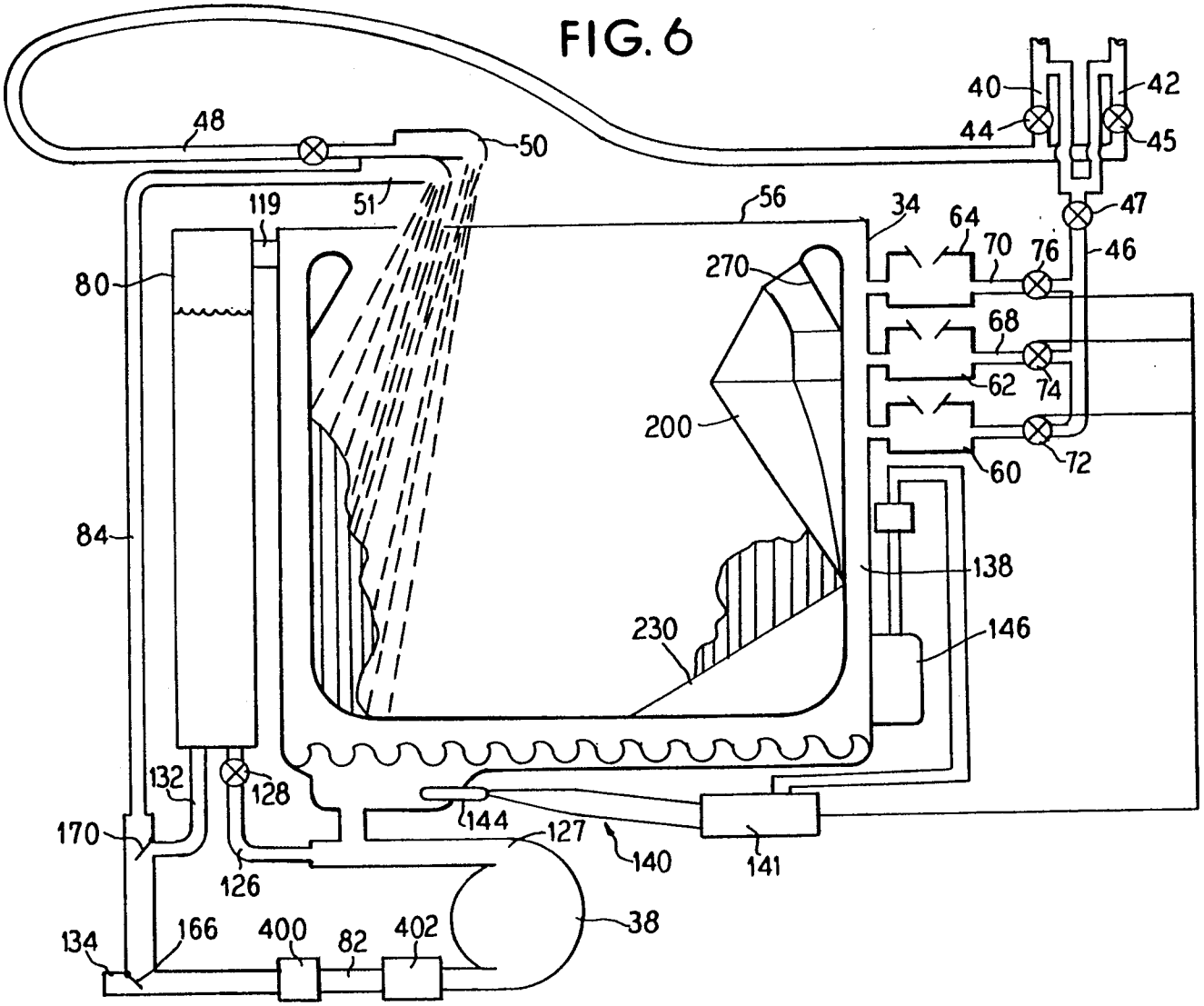
FIG. 6 is a schematic illustration of the fluid conduits and valves associated with the automatic washer.
Figure 10:
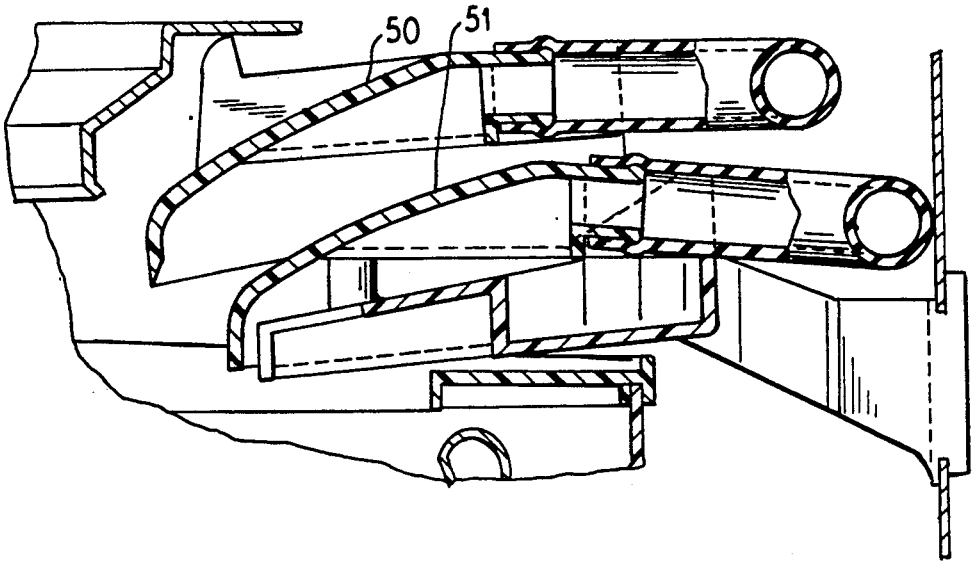
FIG. 10 is a side sectional view of the piggy back recirculating and fresh water inlet nozzles.

Water is supplied to the imperforate tub 34 by hot and cold water supply inlets 40 and 42 (FIG. 6). Mixing valves 44 and 45 and the illustrated production dispenser design are connected to conduit 48. This triple dispenser also contains a by-pass around valves 44 and 45, which terminates in mixing valve 47 which is also part of the standard production dispenser. Mixing valve 47 is connected to manifold conduit 46. Conduit 48 leads to a fresh water inlet housing or spray nozzle 50 mounted in a piggy back style on top of a recirculating water inlet housing or spray nozzle 51 adjacent to the upper edge of the imperforate tub 34. The nozzles 50, 51 which are shown in greater detail in FIG. 10, may be of the type disclosed in U.S. Pat. No. 4,754,622 assigned to the assignee of the present application and incorporated herein by reference, or may be of any other type of spray nozzle. A single nozzle would be a preferred approach if U.L. and other certifying tests and standards could be satisfied.

Figure 4A:
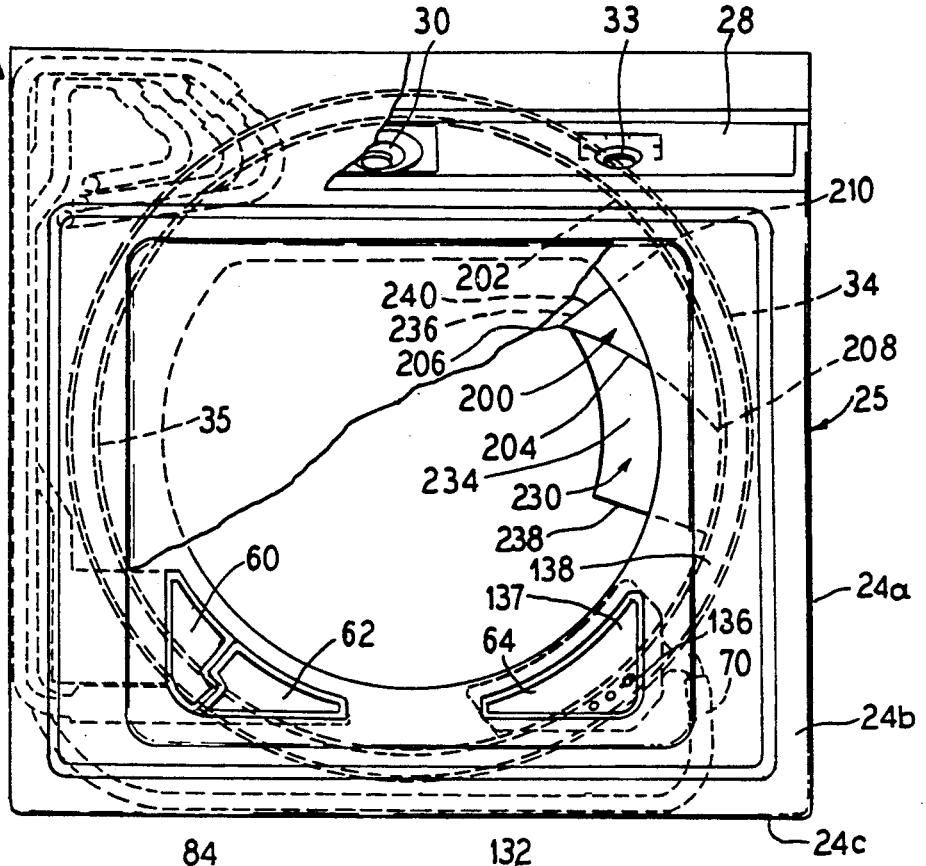
FIG. 4A is a top view of the automatic washer of FIG. 1 with the lid removed.

Surrounding a top opening 56 above the tub 34, just below the openable lid 26, there are a plurality of wash additive dispensers 60, 62 and 64. As seen in FIGS. 1 and 4A, these dispensers are accessible when the hinged lid 26 is in an open position. Dispensers 60 and 62 can be used for dispensing additives such as bleach for fabric softeners and dispenser 64 can be used to dispense detergent (either liquid or granular) into the wash load at the appropriate time in the automatic wash cycle. As shown schematically in FIG. 6, each of the dispensers 60, 62 and 64 are supplied with liquid (generally fresh water or wash liquid) through a separate, dedicated conduit 66, 68, 70 respectively. Each of the conduits 66, 68 and 70 may be connected to a fluid source in a conventional manner, as by respective solenoid operated valves (72, 74 and 76 FIG. 6), which contain built-in flow devices to give the same flow rate over wide ranges of inlet pressures, connecting each conduit to the manifold conduit 46.

Figure 3:
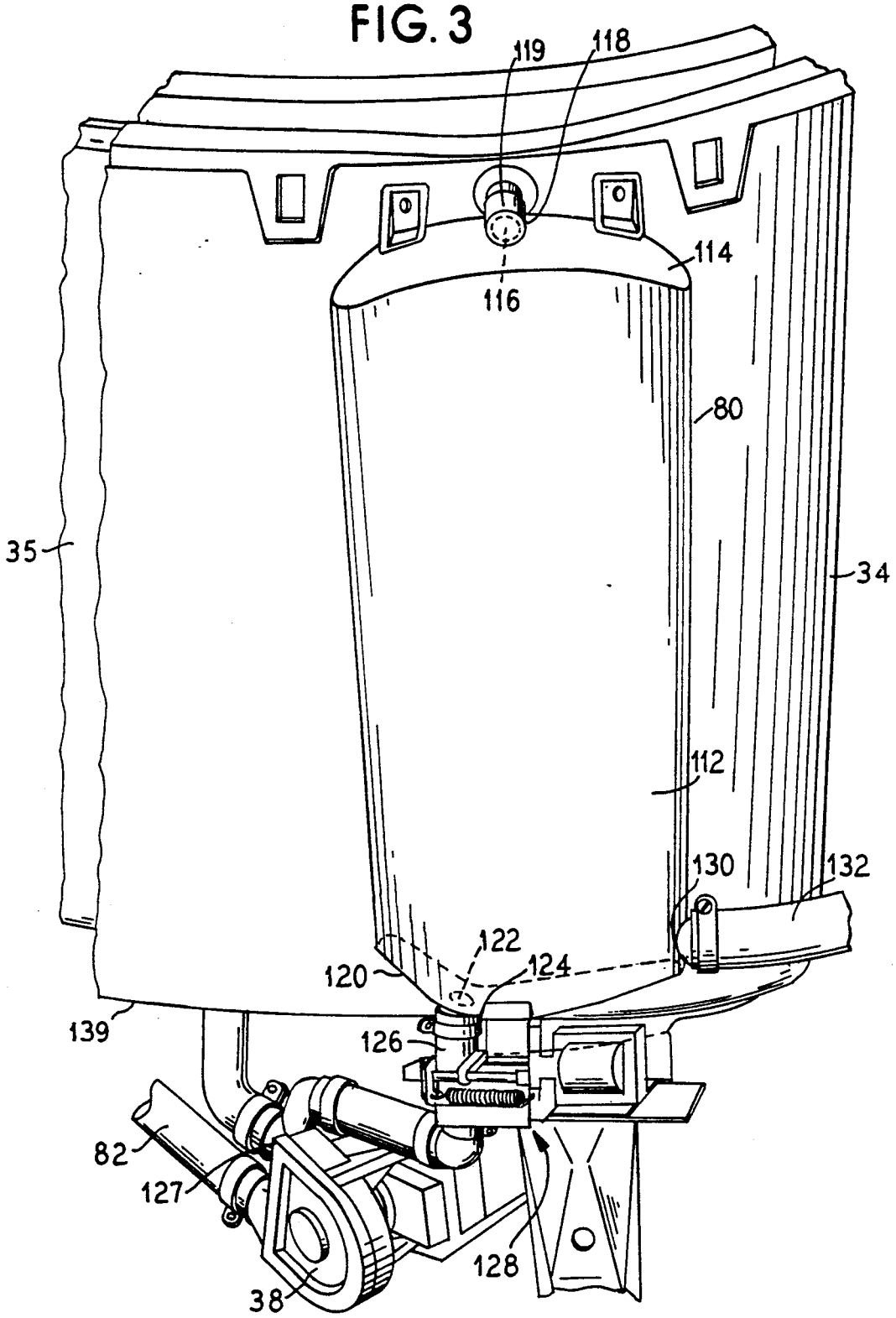
FIG. 3 is an enlarged partial side elevational view illustrating the dispensing tank and associated components.

A mixing tank 80, as shown in FIGS. 1 and 3, forms a zone for receiving and storing a concentrated solution of detergent during the wash cycle, and is used in some embodiments of the invention. As will be described in greater detail below, the mixing tank 80 communicates at a top end with the wash tub 34 and at a lower end communicates with the pump 38, a drain line or conduit 82 and a recirculating conduit 84.

Figure 2:
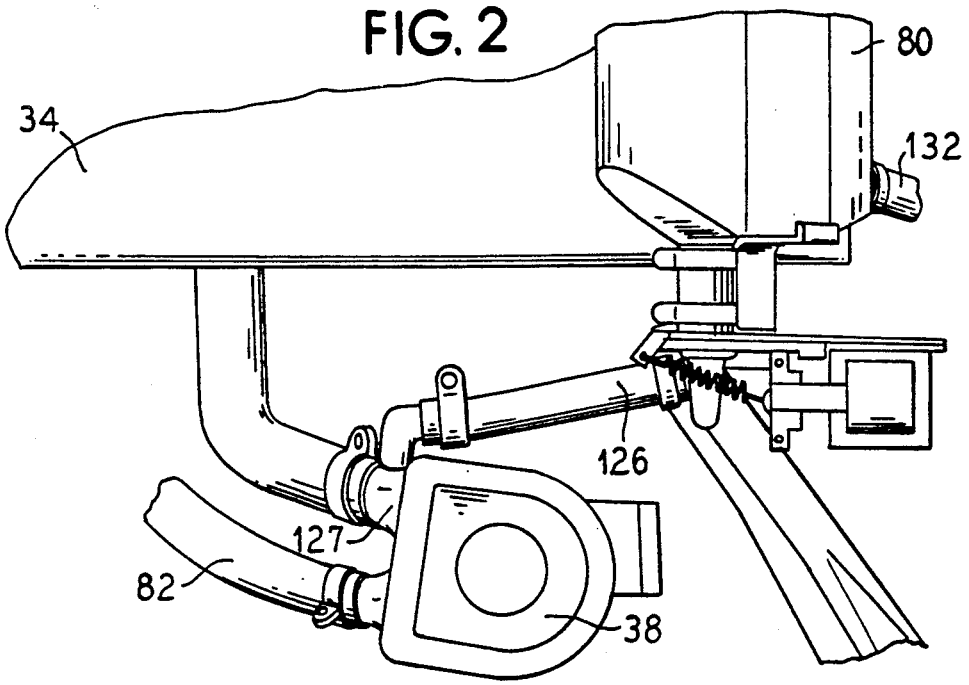
FIG. 2 is a partial front elevational view of the washer of FIG. 1 with the outer wrapper removed to illustrate the interior components.
Figure 4B:
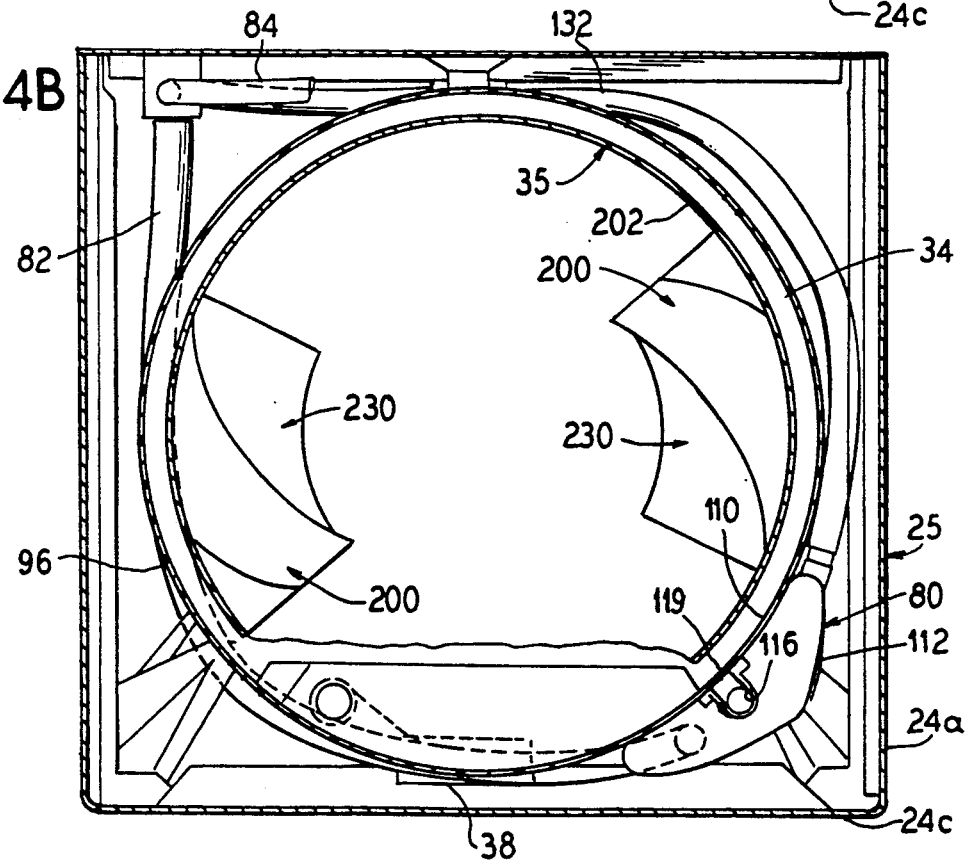
FIG. 4B is a top sectional view of an alternate embodiment the basket taken just below the level of the top panel.

The mixing tank 80 is shown in greater detail in FIGS. 2, 3 and 4B where it is seen that the tank 80 has an arcuate rear wall 110 conforming generally to the circumferential wall 96 of the tub and a somewhat more angular front wall 112 generally paralleling, but being spaced slightly inwardly of the right side wall 24*a* and the front wall 24*c* of the washer cabinet 14. Thus, the tank 80, which is secured to the exterior surface of the tub, fits within a normally non-utilized space within the front right corner of the washer cabinet 25.

The tank 80 has a generally curved, closed top wall 114 with a port 116 positioned at an apex 118 thereof, which port 116 communicates with the interior of the tub 34 through a short conduit 119. The tank 80 also has a curved lower wall 120 with a port 122 at a lowermost point 124. The port 122 communicates, through a conduit 126 with a suction inlet 127 of the pump 38. A selectively actuatable valve mechanism 128 provides selective communication through the passage represented by the conduit 126. Such a valve 128 can be of any of a number of valve types such as a solenoid actuated pinch valve, a flapper valve, or other type of controllable valve mechanism.

A third port 130 is provided through the front wall 112 of the tank 80, adjacent to the rear wall 110 and adjacent to the bottom wall 120. This port 130 communicates by means of a conduit 132 with the conduits 82 and 84 (FIG. 6) which, as described above, are associated with the pump 38, a drain 134 and the recirculating nozzle 51.

The detergent dispenser 64 has openings 136 through a bottom wall 137 thereof which communicate with a space 138 between the basket 35 and tub 34. As described above, the detergent dispenser 64 is provided with a supply of fresh water through conduit 70. The three way valve 47 (FIG. 6) is connected to conduit 70 so as to direct a flow of fresh water to either the detergent dispenser 64, the fresh water spray nozzle 50 directed to the interior of the wash basket 35, or both. Other types of detergent dispensers can, of course, be used with the present invention, including dispensers which hold more than a single charge of detergent and dispense a single charge for each wash cycle.

Positioned within the tub 34, near a bottom wall 139 thereof is a liquid sensor means which may be in the form of a liquid level sensor 140. Such a sensor can be of a number of different types of sensors including a conductivity probe 142 (FIG. 8B), a temperature thermistor 144 (FIG. 6) or a pressure dome 146 (FIG. 8A). Regardless of the sensor type, the liquid sensor type, the liquid sensor must be able to detect either the presence of liquid detergent solution and/or the presence of suds within the sump. A sensor which detects the depth of liquid within the sump may also be utilized. When the sensor makes the required detection, it sends an appropriate signal to a control device 141, as is known in the art, to provide the appropriate control signals to operate the various valves as required at that portion of the wash cycle. As is described in greater detail below, the liquid sensor 140 is used to maintain a desired level of wash liquid within the tub 34 during the recirculating portion of the concentrated wash cycle.

Figure 8B:
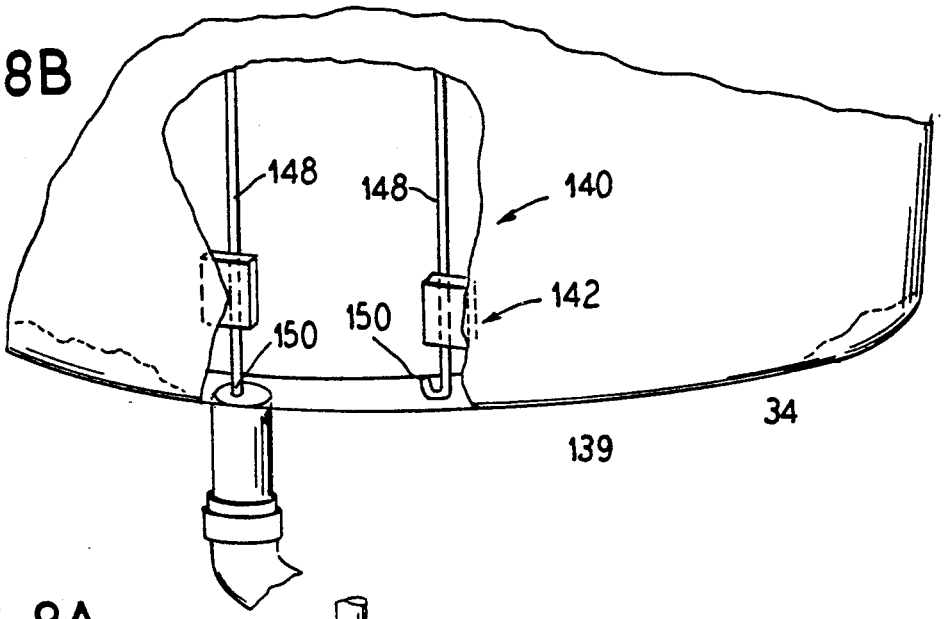
FIG. 8B is a sectional view of the wash tub illustration an electrical probe liquid level sensor.
Figure 8A:
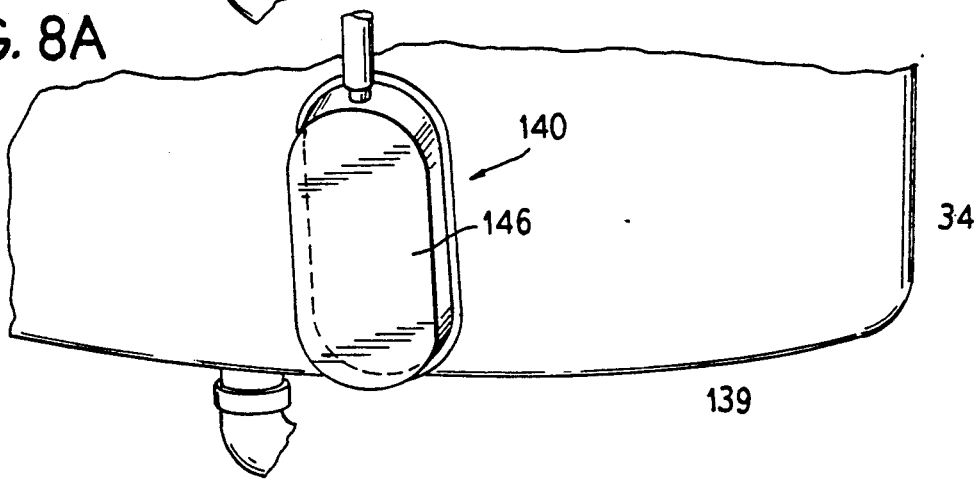
FIG. 8A is a side sectional view of the use of a pressure dome as a liquid level sensor in the wash tub.

The probe sensor 142, shown in FIG. 8B, consists of two insulated stainless steel electrodes 148 having only the tips 150 exposed in the tub 34. When the detergent solution or suds level raises high enough to contact both electrodes, the low voltage circuit is completed indicating the sensor is satisfied.

A thermistor system 144, as generally indicated in FIG. 6, is also located in the tub 34 and is triggered when the water or suds level rises to the designated level, thus cooling the sensor element.

A pressure dome sensor 146, as shown in FIG. 8A and FIG. 6, is similar to pressure domes normally utilized determining liquid level within an automatic washer tub, however it is the positioning of the dome near the bottom of the tub 34, rather than on the upper side of the tub which is the major difference between its usage here and its traditional usage. If a pressure dome sensor 146 is utilized, it must have a setting for spin/spray usage. An indirect inference of water level in the swirl portion of the cycle based on the level of the detergent liquor can be used via algorithms. A pressure dome sensor may also be beneficial in some embodiments of the invention as a sensor to detect an over sudsing condition. If the suds level is too high, then the sensor does not reset. The failure to reset is a means for terminating a spray/spin wash proceeding with the swirl portion of the wash cycle.

Basket Construction

The swirl washer basket 35 has several alternate configurations. Preferably, in each of the configurations, the washer basket 35 utilizes agibasket technology including the lack of a central vertical agitator or stationary center structure.

In each of the preferred arrangements there is at least one baffle 200 (FIG. 4A) which projects inwardly of the annular side wall 202 of the wash basket 35. The baffle has a pair of vertically disposed curved surfaces 204*a*, 204*b* which extend from the basket side wall 202 to a point 206 inward of the side wall. The baffle surfaces 204*a*, 204*b* may be flush with the basket side wall 202 at a vertical edge 208 of the baffle. The baffle 200 may join the basket wall 202 at a second, horizontally spaced vertical edge 210 at an angle of approximately 90° thus defining a vertical wall 212. This type of a baffle is used for one way or unidirectional rotation during the swirl wash portion of the wash and/or rinse cycle.

Figure 4C:
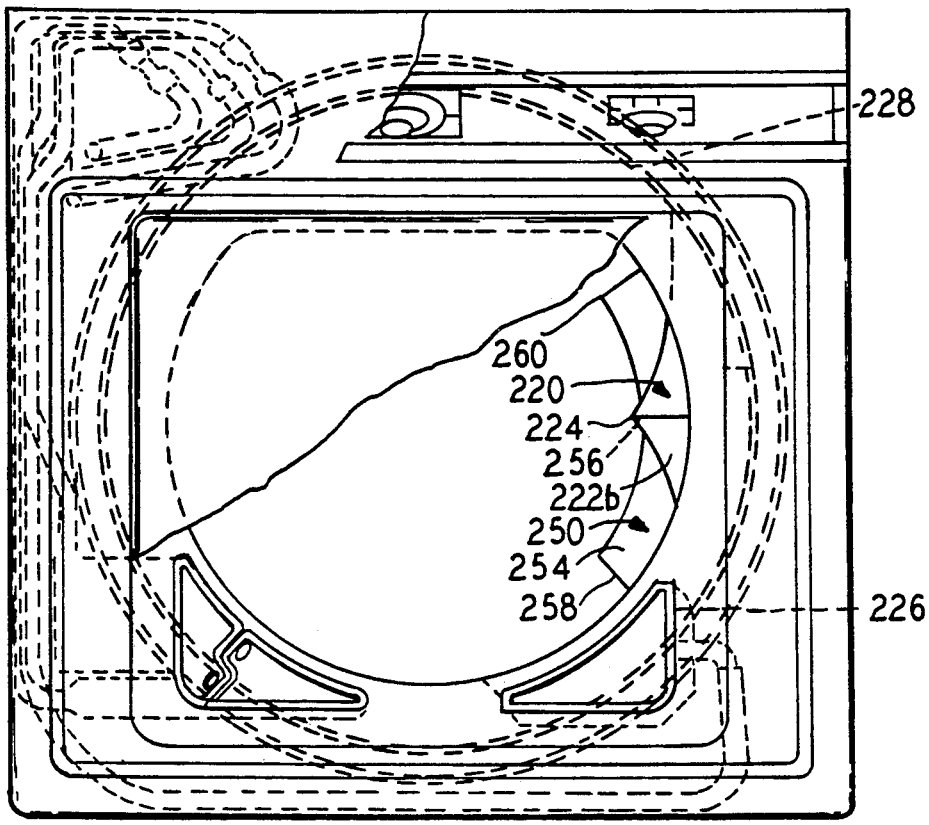
FIG. 4C is an alternate embodiment of the basket in a top view with the lid removed.

A second embodiment of a baffle 220 (FIG. 4C) again has a pair of vertically disposed surfaces 222*a*, 222*b* thereon which extend away from the side wall 202 of the basket to a point 224 inward of the side wall 202. The baffle surfaces 222*a*, 222*b* may be flush with the side wall 202 at a first vertical edge 226 thereof as well as at a second horizontally spaced vertical edge 228. This second type of baffle will permit bidirectional rotation of the wash basket 35 during the swirl wash or swirl rinse portions of the wash cycle.

Figure 4D:
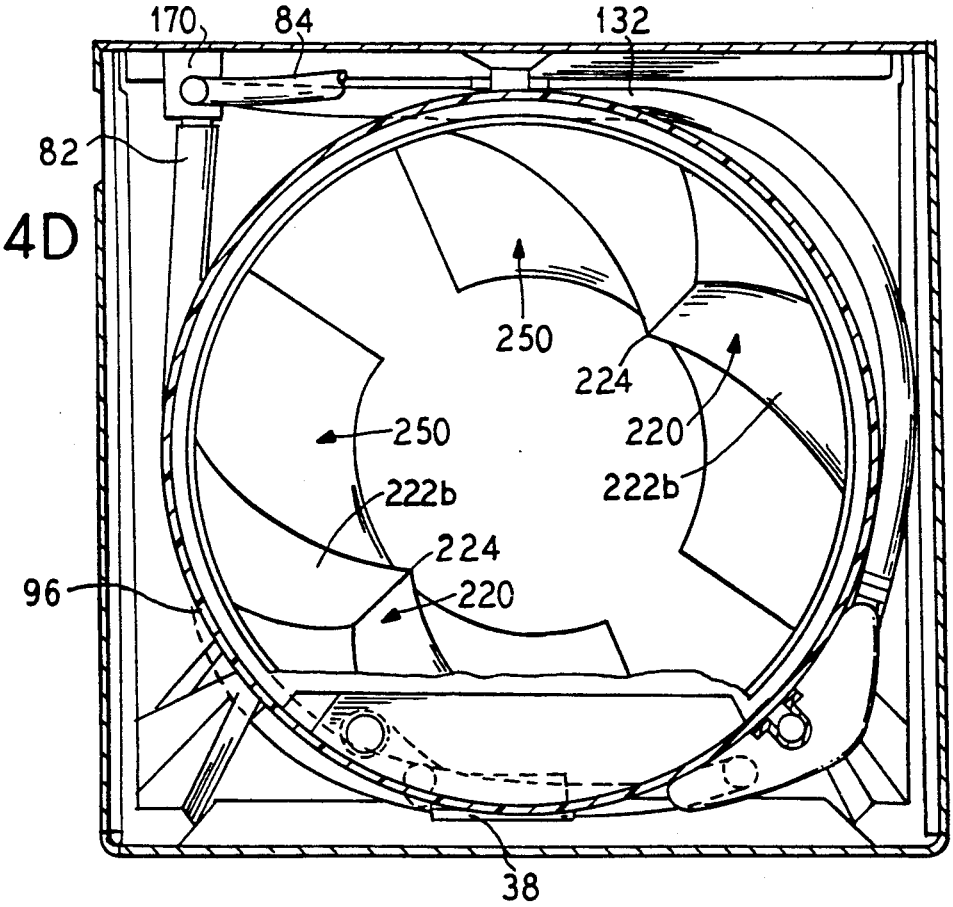
FIG. 4D is an alternate embodiment of the basket in a top sectional view taken just below the level of the top panel.

With either of these types of baffles, either a single baffle may be used (FIGS. 4A and 4C) or, if desired, multiple baffles (FIGS. 4B and 4D) may be used to provide additional balance to the wash basket during the wash cycle.

In the preferred arrangements, there is provided at least one ramp 230 (FIGS. 4A–4D) on a bottom wall 232 of the basket 35. The ramp 230 is positioned adjacent to, but below the baffle 200. The ramp has a substantially horizontal sloped surface 234 thereon which extends from said bottom wall 232 to a point 236 above the bottom wall. The ramp surface 234 may be flush with the bottom wall along one horizontal edge 238 of the ramp. In one embodiment (FIGS. 4A and 4B) a second horizontal edge 240 of the ramp may join the bottom wall 232 at approximately 90° thus defining a vertical wall 242. In an alternate embodiment (FIGS. 4C and 4D), there is a ramp 250 positioned on the bottom wall 232 of the basket 35 which has a sloped ramp surface 254 extending from the bottom wall 232 to a point 256 spaced above the bottom wall. The ramp surface 254 may be flush with the bottom wall 232 at one horizontal edge 258 thereof and may also be flush with the bottom wall 232 at a second horizontal edge 260.

The first type of ramp 230 is to be used in conjunction with the first type of baffle 200 described above for one way or unidirectional rotation of the wash basket during the swirl wash and/or swirl rinse cycles. The second type of ramp 250 is to be used in conjunction with the second type of baffle 220 for either unidirectional or bidirectional rotation of the wash basket. Preferably there is a ramp associated with each baffle with the ramp positioned below the baffle and with the ramp surface 234, 254 leading upwardly toward the baffle surface 204, 222.

As will be described in greater detail below, during the swirl wash and/or swirl rinse portions of the wash cycle, the fabric load within the wash basket is caused to move relative to the wash basket and the geometry of the ramps and baffles is such that the fabric load will slide upwardly along the ramp surface 234, 254 to engage the baffle surface 204*a*, 222*a* which will cause the clothes to tumble over one another in a flexing action to reposition the fabric within the fabric load.

The basket also has an angled barrier 270 positioned near a top 272 of the basket 35 to prevent the wash liquor and/or fabric load from traveling too high in the basket. The basket wall 202 may be sloped outwardly up to 20°–30° from bottom to top. Both the free wash liquor and the fabric loads generally travel to the point of maximum basket diameter during spinning or rotation of the wash basket and thus the inwardly angled barrier 270 would prevent further upward travel.

Utilization of vertical versus sloped basket wall 202 and/or flat versus concave versus convex basket bottom wall 232 offers varying degrees of successful clothes tumbling.

Valve Construction

During the swirl wash and/or swirl rinse portions of the wash cycle it is desireable to keep as much of the wash liquor in the basket 35 as is possible. To that end the wash basket 35 may be constructed in a nearly solid manner, that is, with a minimal number of perforations through the side wall 202. This will significantly reduce the flow of wash liquor from the wash basket 35 into the wash tub 34.

Figure 13:
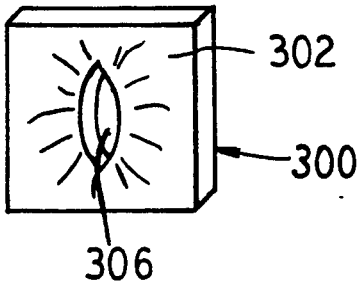
FIG. 13 is an isolated perspective view of the valve member of FIG. 11 in an open position.
Figure 12:
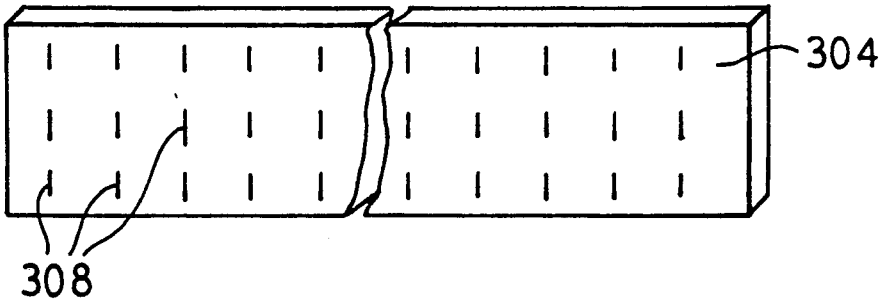
FIG. 12 is an isolated perspective view of a valve sheet.

To enhance the maintaining of the wash liquor in the wash basket 35, the perforations 36 in the wash basket 35 may be provided with valves 300 which restrict the fluid flow through the perforations during the tumble portion of the swirl wash and/or swirl rinse, but permit extraction and fluid flow therethrough during higher spin speeds. These valves 300 may take the form of individual elastomeric sheet-like components 302 which are attached around the basket 35 or they may be grouped into functional units occupying larger areas, such as bands or sheets 304 of elastomeric material. The valve openings are formed as slits or cuts 306, 308 in the elastomeric material. The individual components 302 or sheets 304 can be attached to the outer surface of the basket 35 by appropriate fasteners, or adhesives, generally in the peripheral areas of the valves 300, leaving the central areas where the slits 306, 308 are located, free to flex. When the basket 35 is stationary or is slowly rotating, the slits or cuts 306, 308 will remain virtually closed, thus preventing fluid passage. However, when the rotation of the basket 35 exceeds some predetermined speed, the elastomeric material will deform, since it is attached only around its periphery or at least in portions spaced away from the slits 306, 308, thus the area in which the slit is positioned will flex outwardly due to centrifugal force, opening the slit as shown in FIG. 13. In this condition the valve 300 is open and fluid flow therethrough is permitted.

Although the valves 300 illustrated have only a single linear slit 306, 308, the particular geometry of the valve opening and size can be changed to provide the desired flow therethrough upon reaching some predetermined rotational speed. For example, multiple slits in the form of crosses or stars may also be used.

While valves of this type may provide some control of detergent liquor leaving the basket 35 for the tub 34, they also introduce potential problems with the build up of lime, water minerals, foreign objects and large insoluble soil particles. Thus, the particular geometry for the slits 306, 308 and the particular size of the slits required to overcome these potential problems will be dependent upon the material selected for the valve body.

An optional in-line water heater 400 offers the ability to increase the concentrated wash liquor to an elevated temperature level, thus providing high temperature wash performance at the reduced cost of heating one to one and half gallons of water during the high detergent concentration wash cycle and four to eight gallons of water during the tumble wash cycle. This compares to the cost of heating twenty to twenty-two gallons of water in a traditional washer. The controlled use of an in-line heater 400 combined with high concentrated wash liquor offers special opportunities for specific optimization of detergent ingredients which are activated only in specific temperature ranges. Furthermore, the elevated water temperatures offer the ability to specifically target oily soil removal and reduce the build-up of both saturated and poly-unsaturated oils in fabrics laundered in cold water.

The use of an in-line lint, button, sand and foreign object trap or filter 402 significantly reduces the potential for problems associated with recirculating fluid systems carrying soils and foreign materials. Such a filter is disclosed in U.S. Pat. No. 4,485,645, assigned to the assignee of the present invention, and incorporated herein by reference. Such optional devices would be utilized in a preferred system.

Wash Cycle

Figure 7:
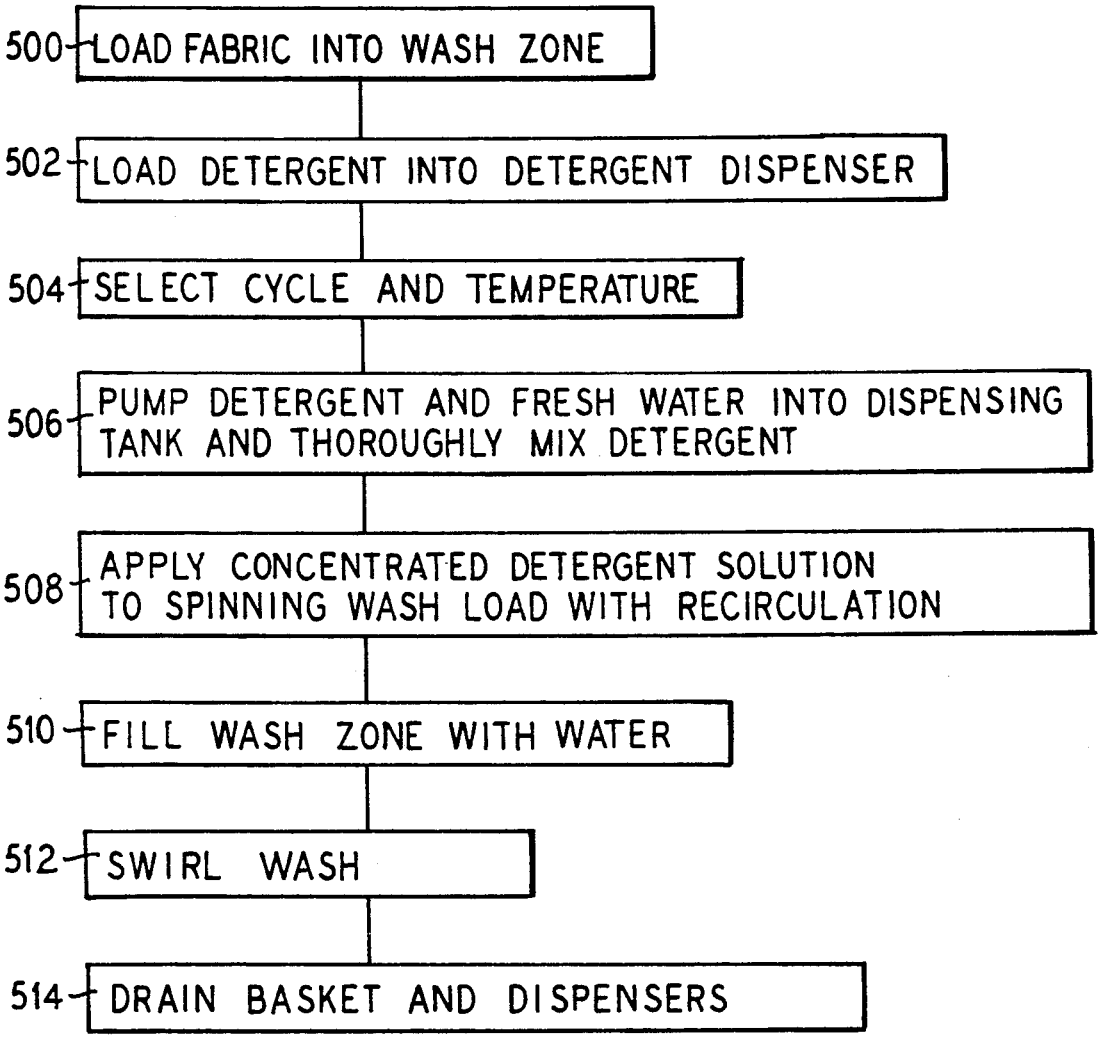
FIG. 7 is a flow chart diagram of the steps incorporated in the concentrated wash cycle.

An improved Wash and rinse cycle is provided in accordance with the present invention and is shown schematically in FIG. 7. In step 500, the washer is loaded with clothes as would be standard in any vertical axis washer. In step 502, the detergent; liquid, powdered, and/or other detergent forms, is added to the washer, preferably through a detergent dispenser, such as the detergent dispenser 64 illustrated, and mixing tank, such as tank 80, at the dosage recommended by the detergent manufacturer. It is possible to add the detergent directly to washer through the basket or directly into the tub through a direct path. The consumer then selects the desired cycle and water temperature in step 504.

The washer is started and the washer basket 35 begins a low speed spin. The preferred speed allows uniform coverage of the concentrated detergent liquor onto the clothes load. A 3-way drain valve 166 and a 3-way detergent mixing valve 170 are turned on and the detergent tank control valve 128 and the detergent water valve 76 are opened. A time delay (approximately 30 seconds) is used to input wash water after which the detergent water valve 76 is closed. As the washer fills, the detergent is washed from the dispenser 64 into the tub 34, past the drain and mixing tank valves 166, and into the mixing tank 80. A time delay (approximately 15 seconds) provide mixing of the detergent with wash water by recirculating the solution in a loop controlled by the valves as indicated by step 506.

In step 508, the detergent tank control valve 128 is closed and a time delay of approximately 15 seconds, but dependent on the size of the mixing tank 80, causes the mixing tank to fill with the detergent solution. The detergent mixing valve 170 is turned off permitting the detergent solution to leave the closed loop and to be sprayed onto the spinning clothes load via the lower nozzle 51 in a piggy back arrangement or one of two nozzles in separate nozzle arrangements. This concentrated detergent solution is forced through the clothes load and through the basket holes due to the centrifugal forced imparted by the spinning basket with potential significant contributions by mechanical fluid flow through the fabric defined by the pumping rate of the detergent liquor. The solution then travels through the basket 35, into the tub 34, down through the pump 38 to be sprayed through the nozzle 51 creating a recirculation loop. The preferred system utilizes a pump exclusively for the recirculation. This ensures sufficient concentrated liquid flow rates without losses due to slower pump speeds associated directly with the drive system. Less effective systems could also use the main pump of the wash system. The process described above utilizes a perforated washer basket, but a nearly solid basket with holes strategically positioned could be used provided the nozzle design provides uniform coverage to the entire clothes load. Such a nozzle design is disclosed in U.S. Pat. No. 4,754,622, assigned to the assignee of the present application, and is incorporated herein by reference.

This step concentrates the effectiveness of the chemistry thus permitting maximum soil removal and minimum soil redeposition even under adverse washing conditions. The high concentrations of detergent ingredients significantly increases the effectiveness of micelle formation and sequestration of oily and particulate soils and water hardness minerals, thus providing improved performance of surfactants, enzymes, oxygen bleaches, and builder systems beyond level achievable under traditional concentrations.

The water level sensor 140, located near the tub bottom, begins to monitor water level concurrent with the opening of the detergent mixing valve 170. Water level control is critical in the swirl washer. Too much detergent solution added will create an over sudsing condition by allowing the spinning basket to contact detergent solution in the bottom of the tub. The preferred method of control is to maintain a minimum level of detergent liquor in the bottom of the tub through the water level sensor. While results suggest that some type of tub modifications (resulting in a sump) permits the HP swirl to function under a wide range of conditions, there are many more common conditions which do not require a tub sump.

A satisfied sensor 140 indicates the system does not require any additional detergent solution at this point in the cycle and the detergent tank valve 128 is closed to maintain the current level of detergent. A satisfied water level sensor 140 early in the wash cycle generally indicates either a no clothes load situation or a very small clothes load. If the sensor is not satisfied, then the detergent tank control valve 128 is opened permitting the addition of detergent solution followed by a five second time delay before again checking the water level sensor 140. If the sensor 140 is satisfied, the detergent tank control valve 128 is closed to maintain the new level of detergent and a thirty second time delay begins to permit the clothes load a chance to come to equilibrium with respect to water retention and the centrifugal forces of extraction created by the spinning basket.

The concentrated wash portion of the cycle (step 508) continues for a time specified by the cycle type. That is, a cycle seeking maximum performance may recirculate the detergent solution through the clothes for 14 minutes or more, while a more delicate or less soiled load will attempt to minimize the length of spinning. The water level sensor 140 monitors the tub 34, adding additional detergent solution from the mixing tank 80 as required. The larger the clothes load the more detergent solution is required. Once the mixing tank 80 is emptied, fresh water is added through the detergent water valve 76 as required by the water level sensor 140.

Swirl Wash Cycle

The spin/recirculation portion of the cycle is terminated after the designated time and the detergent tank control valve 128 is opened with a five second time delay to permit the draining of any remaining detergent solution into the tub 34. The detergent mixing valve 170 is turned on and the detergent water valves and water fill valves 47, 76 are opened to rinse out the detergent mixing tank 80 and begin the first dilution fill.

The fill volume for the swirl wash for step 510 can be indirectly inferred through volume of water used in the concentrated spray wash portion of the cycle in a system utilizing computer control. In more traditional electromechanically control systems, some other method or methods must be used to regulate the fill; i.e., flow regulated timed fill for maximum load volumes, motor torque, and pressure switches.

A water inlet valve 45 is opened to continue the swirl fill through the upper piggy back nozzle 50 (or second nozzle in the separated arrangement) until the water level sensor 140 or other appropriate sensing method is satisfied. Once satisfied, the open valves 45 are closed and the agibasket swirl action begins. The total fill is based on only enough water to slightly suspend the fabric in the wash liquor. This translates to approximately four to six gallons of water for clothes loads ranging in size up to twelve pounds. The water volume requirements increase with increased clothes load size, and uncontrollable parameters include clothes load and fiber composition. The reduction in friction due to a water film between the clothes and the basket appears critical for adequate movement by the clothes load to assure sufficient removal of the suspended and sequestered soils.

Although the concentrated detergent solution is diluted somewhat by step 510, the dilution is not so great as to reduce the detergent concentration to a previously normal concentration of 0.06% to 0.28%. Rather, the detergent concentration remains at an elevated level during the swirl wash step 512. Thus, the extent of mechanical wash action required in step 512 following the concentrated wash step 508 is now significantly reduced relative to traditional systems.

Once the basket 35 has filled the desired amount with water, the basket accelerates slowly to a predetermined speed dependent on the size and number of basket holes, and the leakage rate through the valves. The acceleration may take numerous basket revolutions to achieve the preferred speed where the clothes travel up the side wall 202 of the basket with the assistance of the floor ramp 230, 250, the shape of the basket side wall 202 and the effects of centrifugal forces. The basket 35 is then rapidly decelerated. The clothes load continues to travel in the original direction of rotation due to the contained inertia. The resulting force carries the clothes load over the ramp 230, 250 and in contact with the arcuate slope **204*a*, 222*a* of the side baffle 200, 220**. A gentle tumbling and rolling motion by the clothes load results. Over several acceleration and deceleration cycles, garments previously on the bottom now command a position on top of those garments previously located on the top.

While the utilization of a mechanical brake may be used to achieve the deceleration of the basket, a brake is not necessary. Alternately the direction of the motor may be reversed for some number of revolutions resulting in the transfers of the kinetic energy of the spinning basket to kinetic energy in the opposite direction and potential energy in the form of heat transfer to the motor. This energy could also be utilized to provide additional heating of the wash bath, further improving washability and offering optional heated soaks.

Other designs might transfer the energy to a spring mechanism (not shown) where the energy could be re-converted to kinetic energy to accelerate the basket 35 in the opposite direction in systems utilizing bi-directional ramps 250 and baffles 220. In unidirectional systems the basket 35 would repeat the acceleration in the original direction followed by the reversing. Still other bi-directional systems could simply apply the steps of the first acceleration in the opposite direction.

The utilization of the recirculated spray throughout the tumble portion of the swirl wash recycles wash liquor draining through holes 36 in either the fully perforated basket or the nearly solid basket provides water conservation, and further assists in the application of wash liquor flow through and over the wash load. The hardware utilized for the concentrated spray wash portion of the cycle effectively fits the requirements.

The gentle tumbling wash action alone, even at this elevated detergent concentration, provides barely enough mechanical energy input to offer consumers minimally acceptable wash performance. Thus, the preferred cycle includes the use of a concentrated detergent solution wash step as described above.

The type and length of agibasket swirl action (repeated acceleration and deceleration steps) varies with the cycle desired. For example, maximum time may be selected for maximum soil removal, while lesser times offer less fluid flow and fabric flexing for delicates, silks, wools, sweaters, and other fine washables. If bleach is being added, then valves 47, 74 are opened to allow a reduced amount of liquid chlorine bleach. The physical size of the bleach dispenser 62 can be used to prevent over dosage or a bulk dispenser can be used to regulate dispensing at the appropriate ratio to the volume of water used in the concentrated detergent solution swirl portion of the wash cycle.

The end of the swirl wash is characterized by a neutral drain followed by complete extraction of wash liquor from the clothes load, basket 35 and tub 34 in step 514. The spin speeds are staged so that the load balances itself and reduces the undesired opportunities for suds lock conditions.

All systems described above can use either spray, swirl, flush rinses, and/or combinations for effective rinsing and water conservation.

The Rinse Cycle

Recirculated Spray Rinse Cycle

Figure 9A:
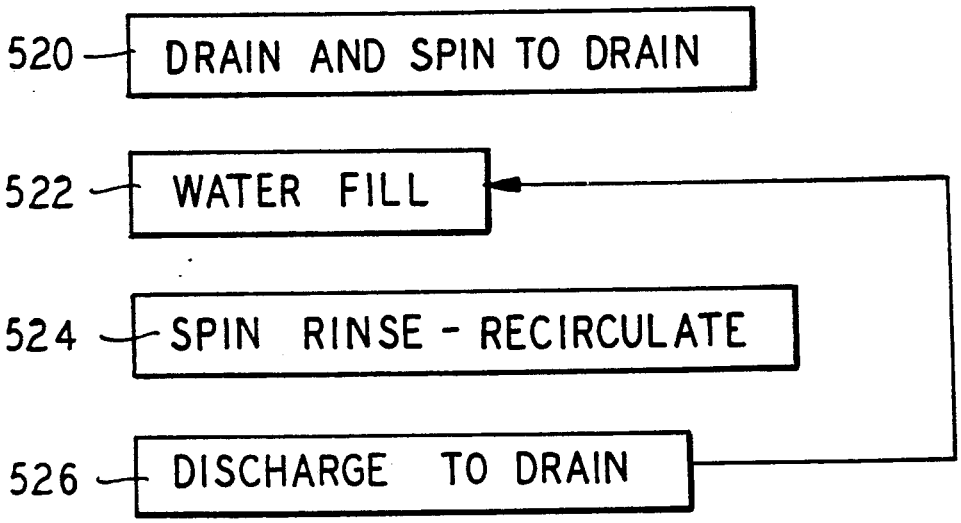
FIG. 9A is a flow chart diagram of a recirculation rinse cycle.

The recirculated spray rinse portion of the cycle, as illustrated in FIG. 9A, is a feature for any vertical axis washer. Its preferred usage is in combination with concentrated detergent solution concepts but is not limited to those designs or methods. The exact hardware utilized for high performance spray washing can be utilized without modification to provide rinsing performance comparable to a classical deep rinse of 10 twenty-two gallons. The recirculated spray rinse cycle uses six to eight serial recirculated spray rinse cycles, consuming approximately one gallon of water each, to provide rinsing, defined by removal of LAS containing surfactants, to a level comparable to that achieved by a deep rinse. Ten or more spray rinses will provide rinse performance superior to a deep rinse.

The basket continues to spin after the final extract of the wash liquor with a fifteen second time delay to assure that all of the wash liquor has been pumped down the drain as shown in step 520. In step 522, the cold water valve 45 is opened until the water level sensor 140 is satisfied and then closed.

In step 524, the fresh water is sprayed directly onto the spinning clothes load. The water dilutes the detergent in the clothes as it passes through the load and basket. The rinse water drains down into the tub and is pumped back through the lower nozzle 51 to form a recirculation loop. The solution extracts additional detergent from the load with each pass. Each recirculation loop is timed delayed thirty seconds, after which the drain valve 166 is turned off and the solution is discharged to the drain as shown in step 526. The drain valve 166 is turned on and the spray rinse loop is repeated for the specified number of spray recirculations.

On the last spray rinse the fabric softener valve 72, and water fill valve 47 are opened for thirty seconds permitting the fabric softener to be rinsed into the tub 34 and pump 38. Water valve 47 and fabric softener valve 72 are closed and the fabric softener is mixed with the last recirculating rinse water. The resulting solution is sprayed onto the clothes load in a recirculation loop for an additional two minutes to assure uniform application of the fabric softener. Additional fresh water is added through the cold water fill valve 42 if the water level sensor 140 becomes unsatisfied. In the final step 526, the drain valve 166 is turned off permitting the final extraction of water and excess softener for sixty seconds.

Swirl Rinse

Figure 9B:
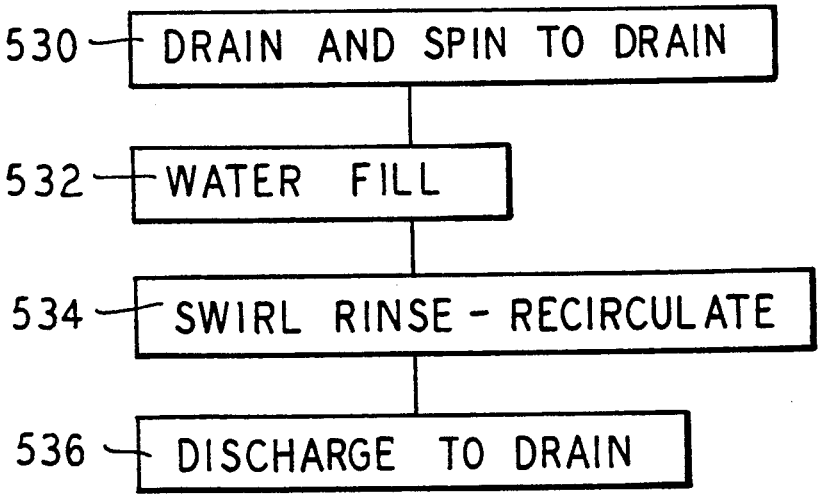
FIG. 9B is a flow chart diagram of a swirl rinse cycle.

The swirl rinse cycle shown in FIG. 9B utilizes the hardware described above for the swirl portion of the wash without modification. In this case two swirl rinses using four to eight gallons of water each are used to equate to the performance of one conventional deep rinse utilizing twenty-two gallons of water. The swirl rinse offers opportunities for more uniform application of fabric softener products than spray rinse in the second rinse.

The basket 35 continues to spin after the final extract of the wash liquor with a fifteen second time delay to assure all of the wash liquor has been pumped down the drain as shown in step 530. In step 532, the cold water valve 45 is opened until the water level sensor 140 is satisfied and then is closed. Other sensing methods may be used. This is approximately four to eight gallons of water. The fresh water is sprayed directly onto the clothes load while the basket accelerates and decelerates as described in the swirl wash section. The water dilutes the detergent in the clothes as it passes through the load and basket 35. The length of the swirl rinse may utilize two rinses of approximately four minutes to approximate a deep rinse. Each swirl rinse loop is timed and followed by a drain and extraction (step 536).

On the last swirl rinse the fabric softener valve 72 and cold water fill valve 47 are opened for thirty seconds permitting the fabric softener to be rinsed into the tub 34 and pump 38. These valves are then closed and the fabric softener is mixed with the last recirculating swirl rinse water. The resulting solution is sprayed and swirled onto the clothes load in a recirculation loop for an additional two minutes to assure uniform application of the fabric softener. In the final step 536, the drain valve 166 is turned off permitting the final extraction of water and excess softener for sixty seconds.

Spray Flush Rinse Cycle

Figure 9C:
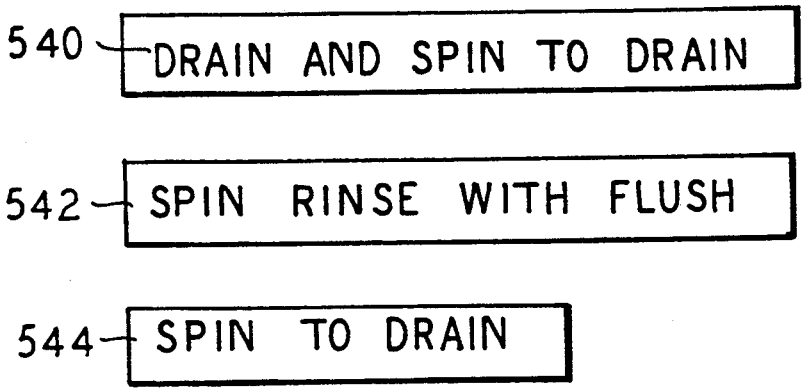
FIG. 9C is a flow chart diagram of a flush rinse cycle.
Figure 11:
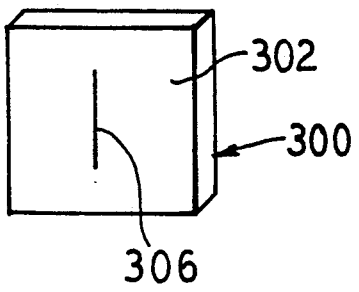
FIG. 11 is an isolated perspective view of an individual valve member.

Spray flush as shown in FIG. 9C offers a less than optimum performance option. The limiting parameter for this system results from the lack of uniform spray coverage and problems associated with the lack of guaranteed water line pressures. The design does not require any additional hardware and consumes relatively small volumes of water in matching the rinse performance of a deep rinse.

In step 540 the basket 35 continues to spin after the final extract of the wash liquor with a fifteen second time delay to assure all of the wash liquor has been pumped down the drain. The cold water valve 45 is opened until the timer is satisfied and then closed. In step 542, the fresh water is sprayed directly onto the spinning clothes load and directly down the drain by means of the closed drain valve 166. On the last flush spray rinse the fabric softener valve 72 and fill valve 47 are opened for thirty seconds permitting the fabric softener to be rinsed into the tub 34 and pump. Water valve 47 and fabric softener valve 72, are closed and the fabric softener is mixed with the last flush rinse water. The resulting solution is sprayed onto the clothes load in a recirculation loop for an additional two minutes to assure uniform application of the fabric softener. Additional fresh water is added through the cold water fill valve 45 if the water level sensor 140 becomes unsatisfied. The drain valve 166 is turned off permitting the final extraction of water and excess softener for sixty seconds in step 544.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of rinsing fabric in a washer having a wash chamber for receiving fabric rotatable about a vertical axis comprising the steps:

(1) adding water to said wash chamber while rotating said wash chamber about its vertical axis a number of revolutions sufficient to cause said fabric, rinse water and wash chamber to rotate at approximately the same speed;

(2) periodically decelerating said wash chamber to cause said fabric and rinse water to move relative to said wash chamber due to rotational inertia of said fabric and rinse water;

(3) causing said fabric to tumble within said wash chamber as said wash chamber decelerates by impinging said fabric on structures in said wash chamber as said fabric is moving relative to said wash chamber;

(4) repeating steps 1-3 for a first period of time;

(5) directing a spray of rinse water onto said fabric during said first period of time as said fabric is rotating with and tumbling in said wash chamber;

(6) draining said rinse water from said wash chamber;

(7) repeating steps 1-6 a predetermined number of times; and (8) spinning and draining said wash chamber to effect removal of said rinse water from said fabric.

2. A method according to claim 1, wherein step (5) further comprises the step of directing a recirculating spray of rinse water onto said fabric during said first period of time as said fabric is rotating with and tumbling in said wash chamber.

3. A method according to claim 1, wherein said washer further comprises a drain, and wherein step 6 further comprises draining said rinse water from said wash chamber directly to said drain.

4. A method according to claim 1, wherein said step of directing a spray of rinse water onto said fabric is terminated during said draining in step 6.

5. A method according to claim 1, wherein said washer further comprises a fabric softener valve and wherein step 7 further comprises opening said fabric softener valve during a last of said predetermined number of times, mixing said fabric softener with said spray of rinse water to form a fabric softener solution, and directing and recirculating said fabric softener solution through said fabric for a selected period of time.

6. A method according to claim 1, wherein said first time period of time is approximately 4 minutes.

7. A method according to claim 1, wherein said predetermined number of times is two times.

8. A method according to claim 1, wherein step (5) further comprises directing a spray of approximately 4 to 8 gallons of rinse water onto said fabric during said first time period.

9. A method according to claim 1, wherein said wash chamber has a nearly solid design, and wherein step (6) further comprises spinning said wash chamber to effect said draining.

10. A method of rinsing fabric in a washer having a wash chamber including a side wall, a floor, a floor ramp, and a baffle, wherein said wash chamber is rotatable about a vertical axis, comprising the steps:

(1) adding water to said wash chamber while rotating said wash chamber about a vertical axis a number of revolutions sufficient to cause said fabric, rinse water and wash chamber to rotate at approximately the same speed;

(2) tumbling said fabric within said wash chamber by periodically decelerating said wash chamber, causing said fabric to impinge said floor ramp and travel up said side wall of said wash chamber to impinge said baffle, thereby causing said fabric to tumble within said wash chamber as said wash chamber decelerates;

(3) repeating steps 1-2 for a first time period;

(4) directing a spray of rinse water onto said fabric during said first time period as said fabric is rotating with and tumbling in said wash chamber;

(5) selectively spinning and selectively draining said wash chamber to remove of said rinse water from said fabric; and (6) repeating steps 1-5 a predetermined number of times.

11. A method according to claim 10, wherein said first time period is approximately 4 minutes.

12. A method according to claim 10, wherein said predetermined number of times is two times.

13. A method according to claim 10, wherein step (4) further comprises directing a spray of approximately 4-8 gallons of rinse water onto said fabric during said first time period.

14. A method according to claim 10, wherein step (4) further comprises the step of directing a recirculating spray of rinse water onto said fabric during said first time period as said fabric is rotating with and tumbling in said wash chamber.

15. A method according to claim 10, wherein said washer further comprises a drain, and wherein step 5 further comprises draining said rinse water from said wash chamber directly to said drain.

16. A method according to claim 10, wherein step (4) is terminated while draining said wash chamber to remove said rinse water.

17. A method according to claim 10, wherein said washer further comprises a fabric softener valve and wherein step 6 further comprises opening said fabric softener valve during a last of said predetermined times, mixing said fabric softener with said spray of rinse water to form a fabric softener solution, and directing and recirculating said fabric softener solution through said fabric for a selected period of time.

18. A method according to claim 10, wherein said wash chamber has a nearly solid design, and wherein step 5 further comprises spinning said wash chamber to effect said draining.

* * * * *